United States Patent [19]

Ito

[11] Patent Number: 4,890,471

[45] Date of Patent: Jan. 2, 1990

[54] PUNCH PRESS FORMING CRT SHADOW MASKS

[75] Inventor: Hideya Ito, Nagaokakyo, Japan

[73] Assignee: Mitsubishi Denki Kabushiki Kaisha, Tokyo, Japan

[21] Appl. No.: 297,283

[22] Filed: Jan. 17, 1989

[30] Foreign Application Priority Data

Jan. 21, 1988 [JP] Japan ..... 63-11208

[51] Int. Cl.[4] ..... B21D 24/00

[52] U.S. Cl. ..... 72/348

[58] Field of Search ..... 72/308, 309, 348, 701, 72/702

[56] References Cited

U.S. PATENT DOCUMENTS

| | | | |
|---|---|---|---|
| 2,075,847 | 4/1937 | Hothersall | 72/348 |
| 3,147,722 | 9/1964 | Williamson | 72/348 |
| 4,615,205 | 10/1986 | Ragland, Jr. | 72/348 |

*Primary Examiner*—Lowell A. Larson

*Attorney, Agent, or Firm*—Sughrue, Mion, Zinn, Macpeak and Seas

[57] ABSTRACT

A CRT shadow mask 9 is made by clamping the outer periphery of a blank, stretch or draw-forming the main spherical surface 9*a* of the mask, releasing the clamping and wipe-forming the skirt 9*c* of the mask, and finally press-forming a peripheral spherical border 9*e* inward of the skirt and having a sharper angle of inclination. The border prevents the spring-back of the high yield strength mask material and the attendant formation of creases and dimples in the mask surface. The die press for implementing the process features an inner pad 32 surrounded by an outer pad 31, both defining spherical surfaces configured to mate with those of a punch 1 for individually forming the main surface and border of the mask. The components are arranged such that a single downward stroke of the press successively implements all of the forming steps.

7 Claims, 5 Drawing Sheets

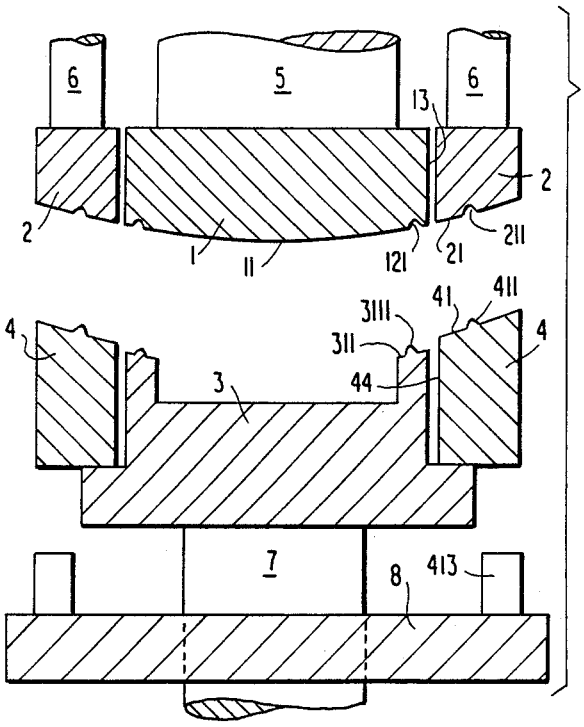
FIG. 1
PRIOR ART
FIG. 2a
PRIOR ART
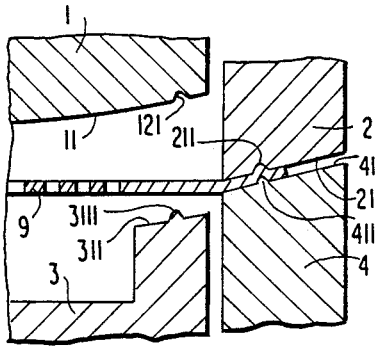
FIG. 2b PRIOR ART
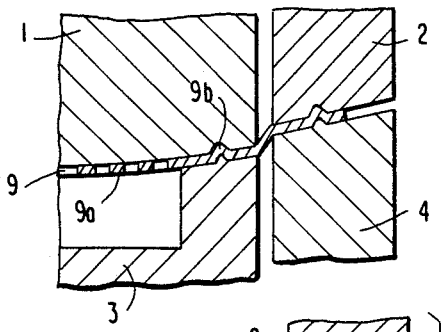
FIG. 2c PRIOR ART
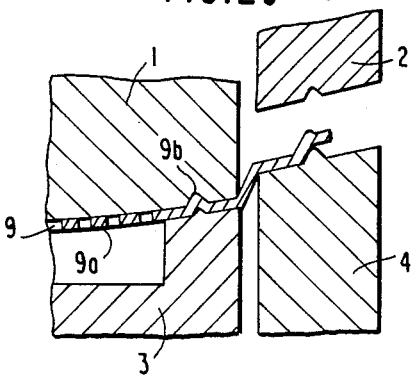
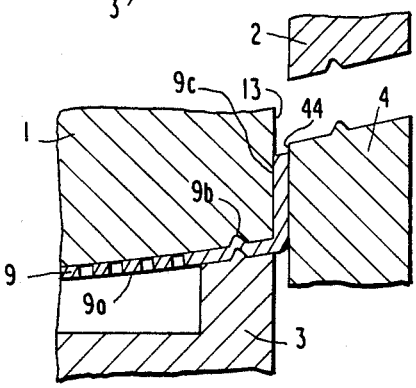
FIG. 2d
PRIOR ART
FIG. 3
PRIOR ART
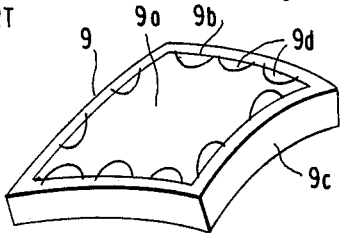

PUNCH PRESS FORMING CRT SHADOW MASKS

BACKGROUND OF THE INVENTION

This invention relates to a method and apparatus for forming shadow masks of color cathode ray tubes using a particularly configured die or punch press machine.

The shadow mask of a color cathode ray tube (CRT) is mounted within a glass panel and serves to establish correspondence between electron beams emitted from the guns in the neck of the tube and the color phosphor deposited on the inner surface of the CRT screen. The shadow mask has a spherical surface made by draw-forming a planar sheet of starting material, and has a plurality of discrete slots or circular apertures of micron dimensions disposed with precise pitches of sub-micron dimensions and formed by photoetching or the like.

Phosphor of the three basic colors are deposited on the CRT screen behind the shadow mask such that they luminesce when impinged by beams passing through the shadow mask slots or apertures. Precise alignment between the shadow mask openings and the phosphor is essential, and any even slight shift or inaccuracy in such alignment results in color sheer or blur on the CRT screen due to the electron beams impinging the phosphor off-center.

A primary cause of such alignment shift is the thermal deformation of the shadow mask, commonly termed "doming". In recent years, ferro-nickel invar alloys of low thermal expansion have been used as shadow mask materials to prevent such doming.

FIG. 1 shows a conventional die or punch press machine for forming shadow masks, and includes a punch 1 having a convex spherical surface 11, a peripheral groove 121 for forming a loop bead in the shadow mask, and a side surface 13 for forming a skirt around the mask. A blank holder 2 surrounds the punch 1, and has a lower clamping surface 21 defining a groove 211. A die pad 3 is disposed below the punch 1 and has a concave peripheral surface 311 corresponding to the convex surface of the punch and a bead 3111 corresponding to the groove 121. A clamping die 4 surrounds the pad 3 below the blank holder 2, and has an upper clamping surface 41 corresponding to the holder surface 21 and a bead 411 corresponding to the groove 211. The punch 1, the blank holder 2 and the pad 3 are respectively mounted on an inner post 5, outer post(s) 6 and a knock-out post 7 of a double-action die press machine. The die 4 rests on a shoulder of the pad 3, and is driven up and down together with the pad.

In operation, a planar sheet of starting material for forming the shadow mask 9 is laid on the die 4 as shown in FIG. 2(*a*), whereafter the blank holder 2 is forced down upon the die 4 to firmly clamp the periphery of the shadow mask via the mating groove 211 and bead 411. The punch 1 is then lowered as shown in FIG. 2(*b*) to draw-form a spherical surface 9*a* of the shadow mask and press-form a loop bead 9*b* in its periphery. The upper surface of the pad 3 is disposed lower than that of the die 4, which improves the performance of the machine. The punch 1, the pad 3 and the die 4 are then lowered together as shown in FIG. 2(*c*) with the blank holder 2 remaining stationary, which releases the outer clamping of the shadow mask. After the die 4 reaches its bottom dead center position the downward movement of the punch 1 and the pad 3 is continued as shown in FIG. 2(*d*), which bends or wipe-forms the skirt 9*c* of the shadow mask between the outer side 13 of the punch and the inner side 44 of the die. After a short pause in the FIG. 2(*d*) position to allow elastic transients to settle out, the components are returned to the Fig. 1 position to release the formed shadow mask.

When an invar alloy material is used as the shadow mask in such a draw-forming process, wavy creases or distortions 9*d* sometimes appear around the edges of the formed mask after its removal due to the "spring back" effect of the high yield strength alloy, as shown in FIG. 3. Such distortions obviously degrade the performance of the CRT, and adversely affect its vibration characteristics.

It is thought that such spring back distortions are attributable to the manufacturing sequence of first forming the spherical surface 9*a* and loop bead 9*b* of the shadow mask, and lastly forming its skirt 9*c*, and in an effort to prevent these distortions and creases when using an invar alloy or the like the conventional press machines have been modified by adding an additional power unit 10*a* as shown in FIG. 4 for bending the skirt inwardly at a sharper angle, and/or by providing a further power unit 10*b* for the punch as shown in FIG. 5 to enhance the stiffness of the shadow mask periphery.

SUMMARY OF THE INVENTION

These drawbacks and disadvantages of the prior art are effectively overcome in accordance with the invention by pressforming a peripheral spherical border surrounding the main spherical surface of the shadow mask inwardly of the skirt, and having a sharper or greater angle of inclination to the overall "plane" of the shadow mask than the edges of the main spherical surface. Such an angled border serves to strengthen and stiffen the mask to thereby prevent the spring-back formation of creases and dimples in the high yield strength mask material, and attendantly avoids any partial stretching or tension breakage of the electron beam apertures.

The implementing apparatus involves separate inner and surrounding outer pads for individually draw-forming and pressforming the main and border surfaces of the shadow mask, respectively. The components of the apparatus are configured and arranged such that a single downward stroke of the press successively implements all of the forming steps.

BRIEF DESCRIPTION OF THE DRAWING

FIG. 1 is a sectional elevation of a conventional die press machine for forming shadow masks, FIGS. 2(*a*) through 2(*d*) are partial sectional elevations illustrating the operational sequence of the FIG. 1 machine, FIG. 3 is a perspective view of a shadow mask formed by the FIG. 1 machine.

DETAILED DESCRIPTION OF THE PREFERRED EMBODIMENTS

Figure 6:
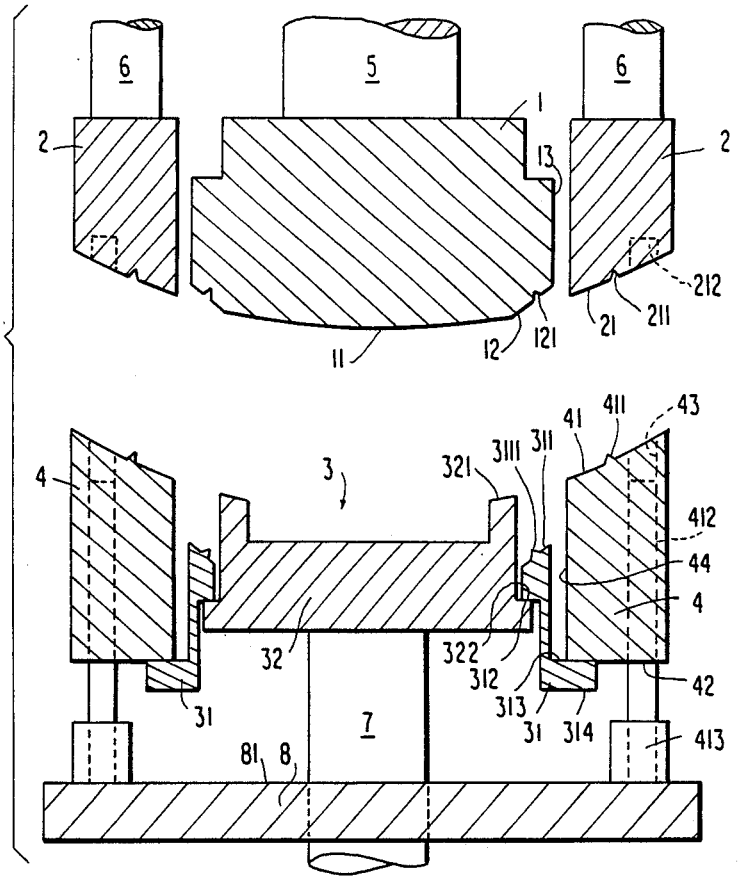
FIG. 6 is a sectional elevation of a die press machine for forming shadow masks in accordance with the invention, FIGS. 7(*a*) through 7(*e*) are partial sectional elevations illustrating the operational sequence of the FIG. 6 machine.
Figure 7A:
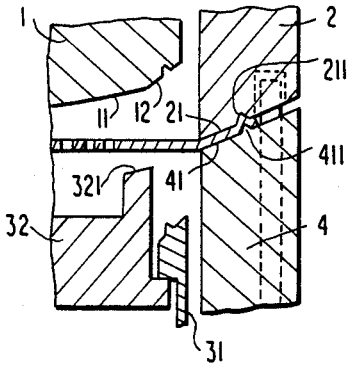
Figure 7B:
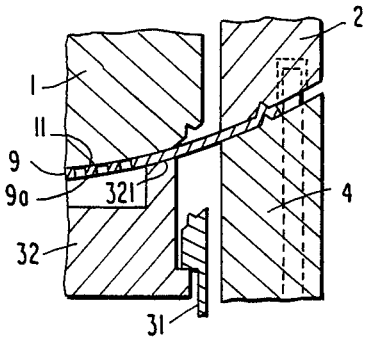
Figure 7C:
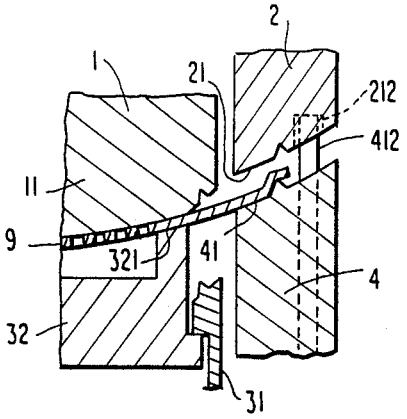
Figure 7D:
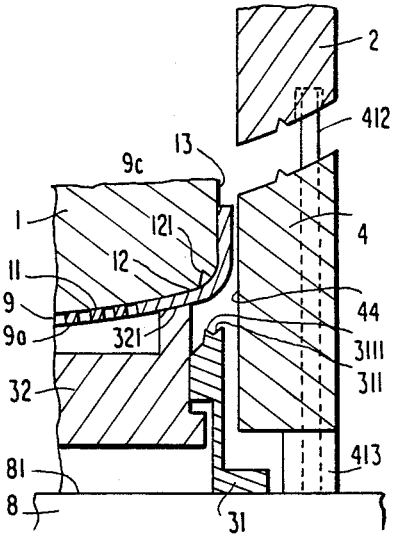
Figure 7E:
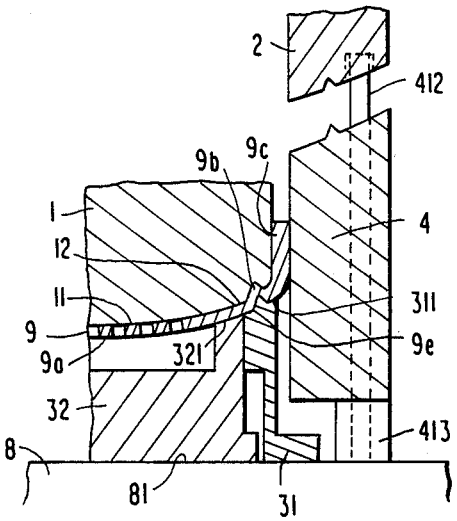

Referring to FIG. 6, wherein components corresponding to those shown in FIG. 1 are designated by the same reference numerals, the bottom of the punch 1 is provided with a peripheral convex spherical surface 12 surrounding the main spherical surface 11 but inclined at a sharper angle than such main surface, and defining the groove 121. The pad 3 is here divided into an inner pad 32 and an outer pad 31, with the inner pad having a concave spherical surface 321 corresponding to the curvature of the punch surface 11. Similarly, the outer pad 31 has a concave spherical surface 311 corresponding to the convex surface 12 of the punch, and defines the projection or bead 3111 configured to mate with the groove 121. A shoulder 312 of the outer pad rests on a corresponding shoulder or lip 322 of the inner pad such that both pads move up and down together under the control of the knockout post 7 extending through the base plate 8. The bottom 42 of the die 4 is supported on the upper surface 313 of a flange 314 extending outwardly from the outer pad, and the up and down movement of the die is thus also controlled by the knockout post 7.

The bottom dead center position of the blank holder 2 is reached when the bottom of a blind bore 212 therein abuts the top of a guide post 412 extending upwardly through a bore 43 in the die 4. The bottom dead center position of the die is reached when its bottom 42 abuts the top of a stop post 413 extending upwardly from the base 8. The bottom dead center position of the punch 1, the inner pad 32 and the outer pad 31 is reached when the bottoms of the inner and outer pads engage the upper surface 81 of the base. The top dead center position of the outer pad is lower than that of the inner pad, as may be seen from FIG. 6.

In operation, after the shadow mask blank is laid on the die 4 the blank holder 2 is lowered to clamp the outer periphery of the blank as aided by the nesting groove 211 and bead 411, as shown in FIG. 7(*a*). The punch 1 is then moved downwardly as shown in FIG. 7(*b*) to stretch or draw-form the spherical surface 9*a* of the shadow mask and further clamp it against the upper surface 321 of the inner pad. The punch and inner pad are then moved further downwardly, together with the outer pad and the die 4 as shown in FIG. 7(*c*), with the blank holder 2 stopping at its bottom dead center position when the bottom of its bore(s) abuts the upper end of the guide post(s) 412. This releases the peripheral clamping of the shadow mask, but it is still firmly pinched between the punch and the inner pad. As the punch and die pads continue to descend the die 4 is halted by the stop post(s) 413, and its inner surface 44 wipe-forms the skirt 9*c* of the shadow mask in cooperation with the outer surface 13 of the punch, as shown in FIG. 7(*d*). At this point the outer pad 31 has bottomed out against the base 8, and the further downward movement of the punch 1 and inner pad 32 to their bottom dead center positions results in the press-forming of a peripheral spherical surface 9*e* and the loop bead 9*b* by the punch and outer pad 31, as shown in FIG. 7(*e*). The components are then returned to their positions shown in FIG. 6 to release the formed shadow mask.

Figure 4:
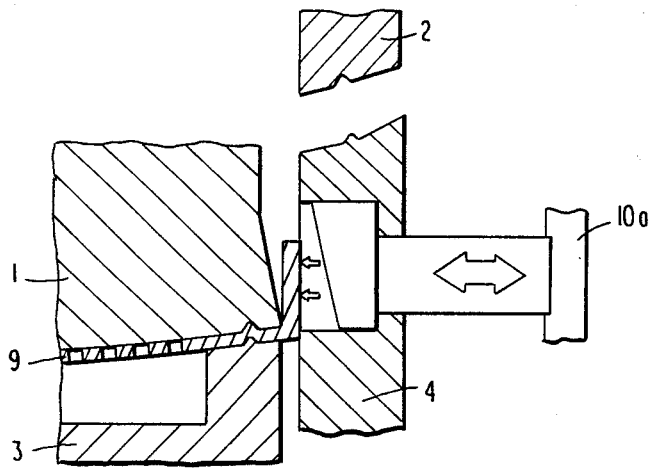
FIG. 4 PRIOR ART
FIG. 4 and FIG. 5 are partial sectional elevations showing conventional modifications of the FIG. 1 machine.
Figure 5:
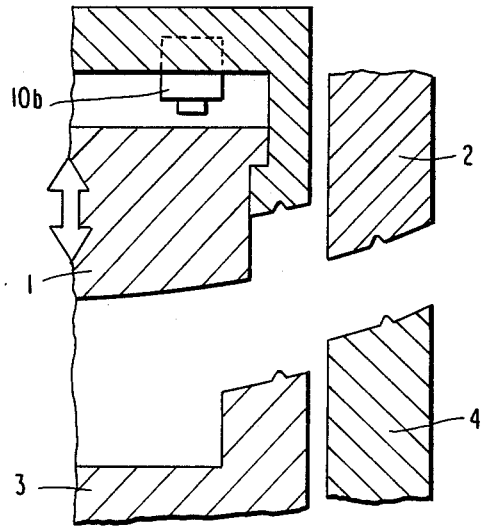
FIG. 5 PRIOR ART

The manufacturing sequence thus involves the stretch-forming of the spherical surface 9*a* of the shadow mask followed by the wipe-forming of its skirt 9*c*, as in the conventional process described above, but now embodies the further and final step of press-forming the peripheral spherical surface 9*e* (and the loop bead 9*b*) intermediate the main spherical surface 9*a* and the skirt 9*c*, which substantially prevents or retards any tendency of the shadow mask material to undergo spring-back upon release to thus avoid the formation of creases, dimples and similar surface distortions. The invention thus enables the use of high yield strength materials such as invar alloys for CRT shadow masks, with their desirable anti-doming properties, without involving the use of any additional power units as shown in FIGS. 4 and 5 to prevent spring-back.

Figure 8:
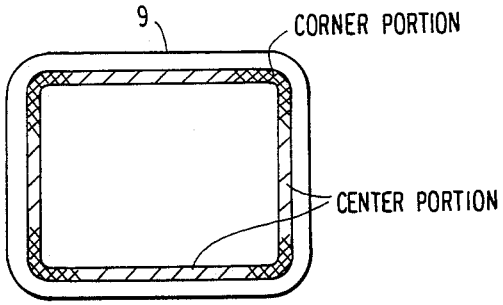
FIG. 8 is a front view of a shadow mask formed by the FIG. 6 machine.

As schematically shown in FIG. 8, a shadow mask 9 formed in accordance with the invention has increased strength and stiffness at the corners of the main rectangular spherical surface 9*a* as compared with the more central or intermediate zones along the edges of such surface due to the respective configurations of the punch surface 11 and the inner pad surface 321. The domed configuration of the mask owing to the non-planar edges of the peripheral spherical surface 9*e*, and the attendantly raised central height of the loop bead 9*b*, also enhances the strength and stiffness of the overall mask.

Figure 9:
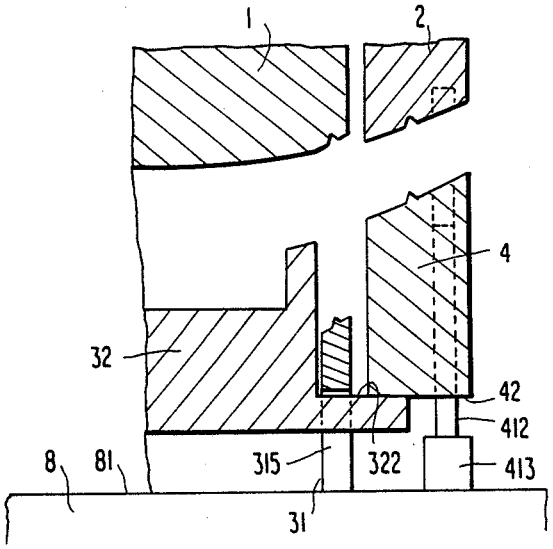
FIG. 9 and FIG. 10 are a partial sectional elevation and a perspective view of the pad 3, respectively, in accordance with modifications of the invention.

In the variant shown in FIG. 9, the outer pad 31 is fixed directly to the base 8 by an extension(s) 315 disposed in a through aperture in the inner pad shoulder 322, which projects farther outwardly than in the FIG. 6 embodiment to support the die 4. The operation is the same as that described above.

Figure 10:
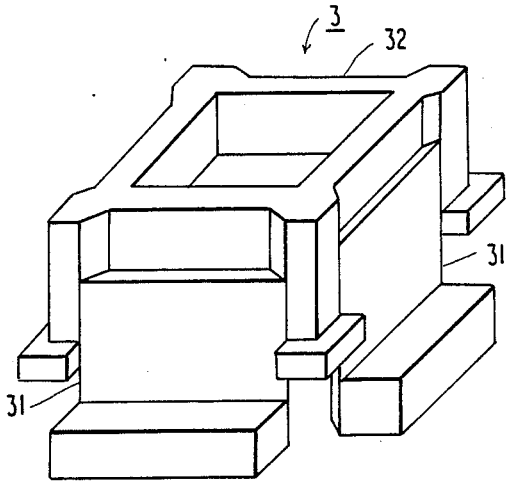

FIG. 10 schematically illustrates an alternative wherein the outer pad 31 is formed as four discrete elements arranged along the respective sides of the inner pad 32, rather than completely surrounding the latter as in the FIG. 6 embodiment.

As a further alternative, the groove 121 and mating projection 3111 for press-forming the lip bead 9*b* may be provided around the periphery of the main spherical surface 11 of the punch and on the surface 321 of the inner pad, respectively.

What is claimed is:

1. A method of forming a color CRT shadow mask of high yield strength material, comprising the successive steps of:

(a) horizontally clamping a periphery of a planar blank of said material, (b) applying a punch (1) to an upper surface of the blank to draw-form a main spherical surface (9*a*) of the mask, (c) releasing the peripheral clamping, (d) bending the periphery of the blank upwardly to form a skirt (9*c*) surrounding the main spherical surface of the mask, and (e) press-forming a border spherical surface (9*e*) surrounding the main spherical surface of the mask inwardly of the skirt and inclined at a greater angle to the horizontal than edges of said main spherical surface such that said border spherical surface prevents spring-back of the thus formed mask upon release and the attendant formation of creases or dimples in the main spherical surface of the mask.

2. A method according to claim 1, further comprising, concurrently with step (e), forming a loop bead (9*b*) in said border spherical surface.

3. A method according to claim 1, further comprising, concurrently with step (b), clamping an outer edge of the main spherical surface between the punch and a die means (32) disposed therebelow, and maintaining said outer edge clamping throughout steps (c), (d) and (e).

4. A die press apparatus for forming a color CRT shadow mask of high yield strength material, comprising:

(a) a horizontally oriented base (8), (b) a punch (1) disposed above the base and vertically movable towards and away therefrom, said punch having a convex spherical bottom (11) for draw-forming a main spherical surface (9*a*) of the mask, and a convex spherical border (12) surrounding said bottom and inclined at a greater angle to the horizontal than said bottom for press-forming a border spherical surface (9*e*) of the mask, (c) a blank holder (2) disposed surrounding the punch, vertically movable towards and away from the base, and having a bottom surface configured to clamp a periphery of a shadow mask blank inserted into the apparatus, (d) a clamping die (4) disposed above the base and below the blank holder, vertically movable towards and away from the base, having an upper surface configured to mate with the bottom surface of the blank holder, and an inner surface configured to bend-form a skirt (9*c*) of the mask in cooperation with an outer side surface of the punch, said clamping die having a bottom dead center position lower than that of the blank holder, (e) an inner pad (32) disposed below the punch and within the clamping die, having an upper concave spherical surface (321) for draw-forming said main spherical surface of the mask in cooperation with the convex spherical bottom of the punch, vertically movable towards and away from the base, and having a bottom dead center position lower than that of the clamping die, and (f) an outer pad (31) disposed below the punch, around the inner pad and within the clamping die, vertically movable relative to the inner pad, and having an upper concave spherical surface 311 for press-forming said border spherical surface of the mask in cooperation with the convex spherical border of the punch upon the inner pad reaching its bottom dead center position.

5. An apparatus according to claim 4, further comprising a groove (121) formed in the punch border and a mating projection (3111) upstanding from the upper surface of the outer pad for press-forming a loop bead (9*b*) in the mask.

6. An apparatus according to claim 4, wherein a shoulder (312) of the outer pad is supported on a corresponding flange (322) of the inner pad and the clamping die is supported on a corresponding flange (314) of the outer pad, such that both the clamping die and the outer pad are movable together with the inner pad.

7. An apparatus according to claim 4, wherein the outer pad is fixed to the base via a mounting post (315) extending upwardly through an aperture in a flange (322) extending outwardly from the inner pad, and the clamping die is supported on an upper surface of said flange such that the clamping die is movable together with the inner pad.

* * * * *